United States Patent [19]

Boyd

[11] 4,004,708

[45] Jan. 25, 1977

[54] FIRE-RESPONSIVE TANK TOP

[75] Inventor: Martin C. Boyd, West Chester, Pa.

[73] Assignee: Philadelphia Suburban Corporation, Bryn Mawr, Pa.

[22] Filed: Dec. 19, 1975

[21] Appl. No.: 642,608

[52] U.S. Cl. ..... 220/224; 220/88 R; 220/89 B; 220/226

[51] Int. Cl.[2] ..... B65D 87/227

[58] Field of Search ..... 220/88 R, 88 A, 89 B, 220/216–227

[56] References Cited

UNITED STATES PATENTS

| | | | |
|---|---|---|---|
| 2,302,904 | 11/1942 | Wiggins | 220/224 |
| 2,437,125 | 3/1948 | Plummer | 220/221 |
| 2,452,118 | 10/1948 | Florence | 220/89 B X |
| 2,754,026 | 7/1956 | Wiggins | 220/224 |
| 2,802,591 | 8/1957 | Wiggins | 220/219 |
| 2,973,113 | 2/1961 | Find | 220/224 |
| 2,981,438 | 4/1961 | Heisterberg | 220/219 |
| 3,043,468 | 7/1962 | Horner, Jr. | 220/226 |
| 3,119,510 | 1/1964 | Wiggins | 220/226 |
| 3,119,511 | 1/1964 | Giannini | 220/226 |
| 3,185,335 | 5/1965 | Lecler | 220/222 |

*Primary Examiner*—William Price
*Assistant Examiner*—Stephen Marcus
*Attorney, Agent, or Firm*—Connolly and Hutz

[57] ABSTRACT

Floating tank top pivotally carrying upwardly projecting weather shield plates around its periphery for biasing outwardly against inside surface of tank wall, has bias mechanism arranged to tilt the plates inwardly in response to fire to expose roof seal at site of fire and help direct fire-fighting foam into exposed location.

4 Claims, 6 Drawing Figures

FIRE-RESPONSIVE TANK TOP

The present invention relates to tanks of the type used for bulk storage of flammable liquids such as hydrocarbons.

Among the objects of the present invention is the provision of tank constructions in which fires are more readily detected and extinguished.

The foregoing as well as other objects of the present invention are more fully explained in the following description of several of its exemplifications, reference being made to the accompanying drawings in which.

According to the present invention to floating top of a floating top bulk storage tank for gasoline or similar liquids, is improved to make it easier and more effective to fight a fire in the seal area. Thus one standard type of floating top construction has a set of weather shield plates each extending upwardly and pivotally mounted around the periphery of the top, with bias means like a spring urging the plates outwardly so they engage against the inner surface of the tank wall. Such a construction is illustrated in page 11–79 of the Appendix to "Foam Extinguishing Systems", National Fire Protection Association Standard No. 11, 1975 Edition, and the plates keep rain and snow from directly dropping on a resilient packing seal secured around the outer face of the floating top and slidably squeezed against the tank wall. Such rain and snow fall onto the weather shield plates which divert them to the upper surface of the floating top where they can accumulate or be drained through roof drains or the like.

The improvement effected by the present invention changes the bias for the plates, making it respond to the heat of a fire by tilting the upwardly projecting plates inwardly so they expose the roof seal and help lead fire-fighting materials such as foam to the seal area at which the fire has developed.

Figure 1:
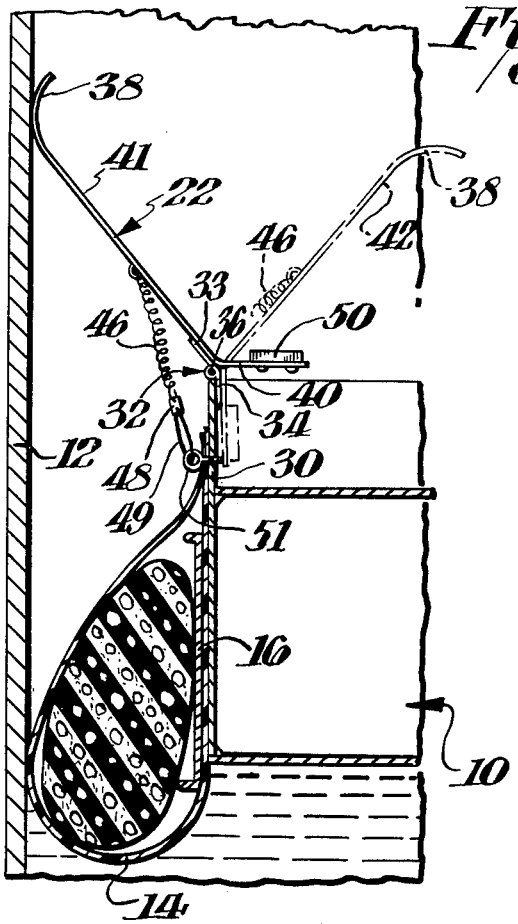
FIG. 1 is a detail vertical sectional view of a tank construction pursuant to the present invention.
Figure 2:
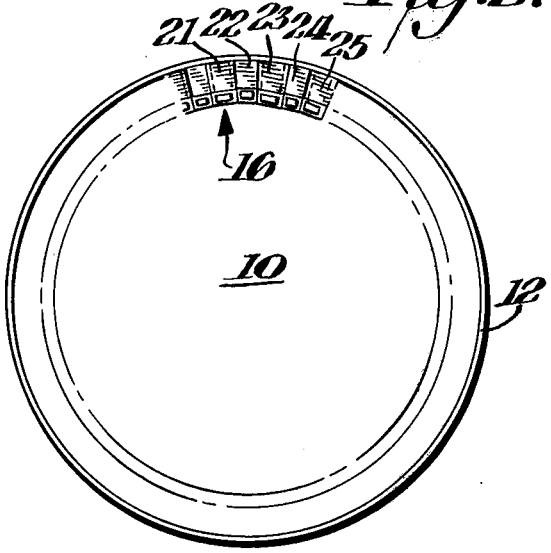
FIG. 2 is a view of an entire tank according to the present invention, looking down at it from above.

Turning now to the drawings, FIGS. 1 through 4 show the general aspects of one embodiment of the present invention. A floating top 10 is fitted in a tank shell 12 and carries a resilient packing seal 14 having a urethane foam core for example, as well as a series 16 of weather shield plates. An adjacent group of the plates in FIG. 2 is numbered 21, 22, 23, 24 and 25. The plates are shown as pivotally mounted on the upper edge of the rim 30 that surrounds the floating top, a hinge 32 having two hinge plates 33, 34 connected by hinge pin 36 being provided for this purpose. Hinge plate 33 is secured to a weather shield plate, as by riveting, and hinge plate 34 is bolted or otherwise fastened to the upper edge of rim 30. The weather shield plate such as plate 22 as illustrated in FIG. 1, has its upper edge 38 curved upwardly and is secured to the hinge at a position which brings the curved end 38 into engagement against the tank shell 12 with the body 41 of plate 22 held at an angle of about 30 to 60° with respect to the vertical. In this way the weather shield plate will ride up and down the tank shell as the floating top 10 is moved up and down by changes in the volume of liquid in the tank.

The lower end 40 of shield plate 22 is shown as bent away from the plane of the body of the plate so that the lower end is approximately horizontal when the shield plate rests against the tank shell. This provides about 90° of tilting clearance for the lower end 40 of the shield plate so that it can tilt that far around hinge pin 36 and correspondingly tilt the body of plate 22 inwardly the same amount. Such inward tilt position is shown by the dash lines 42, and when the inward tilt position is between about 30° and about 60° with respect to the vertical it provides very effective funneling that directs fire-fighting foam down to the resilient seal 14.

Biasing means, including tension spring 46, is secured between the body of shield plate 22 and the top rim 30 through a fusible link 48 and a length of cable 49, to urge the shield plate into engagement with the tank shell. Counterweight 50 is shown as mounted on the lower portion 40 of the shield plate to tilt the body of the shield plate inwardly when the fusible link fuses and thus disconnects spring 46. The counterweight can however be replaced by a coil spring fitted around hinge pin 36 and biased so as to provide the desired tilt to position 42 when spring 46 is not connected.

Figure 4:
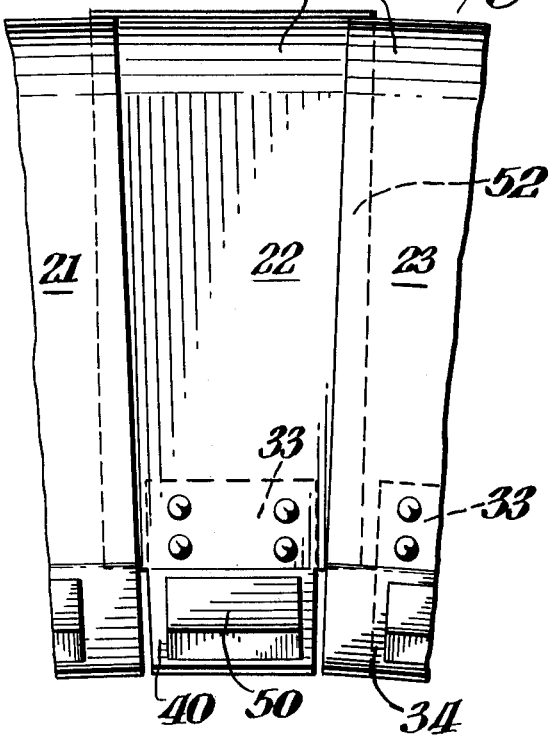
FIG. 4 is an enlarged detail of the view shown in FIG. 2.
Figure 3:
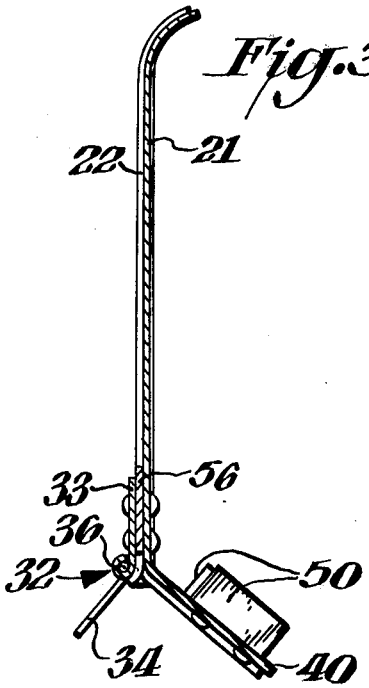
FIG. 3 is a sectional detail view showing the interrelation between some portion of the construction of FIGS. 1 and 2.

Each of the weather shield plates such as those numbered 21 through 25, can overlap its adjacent plates as indicated at 52 in FIG. 4, to improve the shielding effect, although this is not necessary since some water and even snow can be permitted to drop onto resilient seal 14. Shield plate overlapping is conveniently effected by having the bodies of the shield plates disposed in two conical tiers, one tier being just above the other and alternate shield plates being in different tiers. Thus plates 22 and 24 are shown in the upper tier, plates 21, 23 and 24 being in the upper tier and partially overlapped by plates 22 and 24. In this arrangement the hinges of all the plates can have their hinge pins at the same height with respect to the floating top 10, but alternate plates can have a shim 56 between it and the hinge plate 33 to which it is secured.

As shown in FIG. 4, the lower portions 40 of alternate overlapping shield plates can have their widths trimmed back so they do not overlap the lower portions of adjacent shield plates, and this arrangement permits the shield plates in the higher tier to tilt to inward position without interference between the lower portions 40 of adjacent plates. Accordingly the fusing of the fusible link for a higher tiered shield plate in the overlapping assembly, will permit that shield plate to be moved to its dash-lines position 42. A similar operation of the next adjacent higher tiered shield plate can also be accomplished by the melting of the fusible link for the latter plate, and after two such adjacent higher tiered are tilted in, the lowered tiered shield plate between them is also free to tilt in when its fusible link fuses.

The width trimming need not be confined to the alternate plates, as shown in FIG. 4. Instead every weather shield plate can have the width of its lower portion 40 narrowed a bit to provide the foregoing avoidance of interference. When made this way all of the plates can be of indentical shape.

Fires in combustible liquids contained in tanks having floating tops generally start in the seal area. Inasmuch as the floating roof is only held up by buoyancy, being only partly submerged in the combustible liquid within the tank, the seal area is generally the only location in which the liquid can come in contact with the air required for combustion. The weather shield plates of the prior art are arranged not only to keep rain and snow from dropping into the seal area in excessive amounts, but they also deflect foam or other fire-extinguishing materials applied to the tank top to put out any fire in the tank. With such prior art construction it is accordinly difficult to extinguish a fire by applying fire-fighting materials. Thus foam generally has to be applied to such tanks in amounts so large that it builds up over the entire floatng roof to a level that covers the weather shield plates at the location of the fire.

With the construction of the present invention on the other hand, the occurrence of fire will be quickly followed by the fusing of those fusible links that are heated by the fire and the weather sheild plates in that location will be automatically tilted back into position 42. The projection of a stream of foam into the tank so that it strikes the inside surface of the tank shell above the fire area, the normal technique for applying the foam, will cause that foam to be directed by the shield plates in position 42, to the fire. The extinguishing of fires is accordingly greatly speeded. This not only reduces the hazard of having the fire ignite something else nearby, but it cuts down the losses of liquids otherwise consumed by the additional burning in the prior art constructions and it also greatly reduces the danger that the fire will burn through or warp the seal or roof or shell and thus precipitate a conflagration.

Another feature of the present invention is that it helps speed the early detection of a fire as well as more direct application of fire fighting materials. Thus the inward tilting of the shield plates to expose the seal permits any fire causing such tilting to project its flames higher so that they are more readily seen and more readily detected. Where the storage tank is equipped with one or more foam chambers around its upper periphery, and those foam chambers contain fire detection controls that automatically initiate foam application, the stronger flame action resulting from the exposure of the seal hastens the triggering of the foam chamber action. Moreover, where there are a plurality of foam chambers on a single tank such as is usually the case with tanks of very large diameter, the localized shield plate tilting of the present invention will cause the application of foam from the nearest foam chamber so that the foam so applied is more effective in fighting the fire. Foam chambers are generally designed to discharge their foam against the inside surface of a tank wall and this makes a particularly effective combination with the shield plate tilting action of the present invention.

While the funneling effect described above in connection with FIG. 1 is exceedingly helpful, the mere opening of the seal area by some tilting of the weather shield plates is enough to make a significant improvement in the extinguishing of a fire. Thus the shield plates can be tilted inwardly much further than indicated in FIG. 1 and far enough so that the body 41 of the shield plate becomes generally horizontal, but this is not as desirable. Similarly the shield plates can have their thermally-responsive bias arranged to merely tilt them to the generally vertical position, and greatly improve the extinguishing of fires in this way, although again this is not as desirable.

Figure 5:
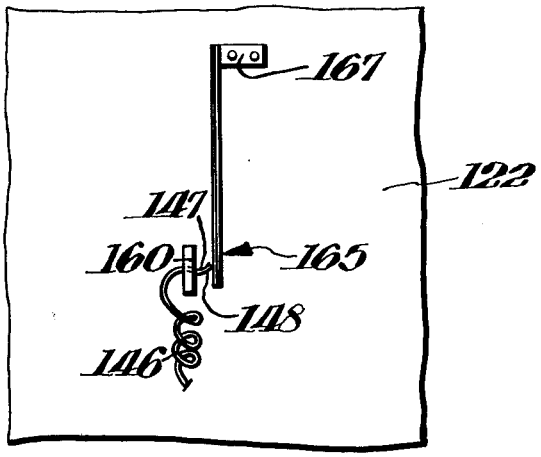
FIG. 5 is a detailed view from below of a portion of the tank top showing a modified construction in accordance with the present invention.

Instead of having the fusible link 48 in the arrangement that is shown in FIG. 1, a fusible member can be used as for example the eye 51 secured to plate 22 and to which spring 46 is hooked, or the cable 49 can be made of fusible material such as polypropylene. Alternatively the fusible link can be replaced by a bimetallic actuator that disconnects the spring 46 in response to a fire. Such an arrangement is illustrated in FIG. 5 which shows the undersurface of the body of weather shield plate 122 having an eye 160 through which the end 147 of outwardly biasing spring 146 is hooked. Spring end 147 has its terminal portion 148 inclined away from the direction in which the spring 146 pulls, and a bimetallic actuator 165 is mounted by bracket 167 to engage the terminal portion. Upon being heated by a fire, actuator 165 flexes in the direction that pushes the spring end 147 out through eye 160 until the inclined terminal portion 148 is the only portion of the spring end in contact with the hook, at which point the spring tension itself pulls the spring end 147 completely out of the hook. The outward bias of the spring plate is accordingly terminated and the inward tilting bias takes over to tilt plate 122 into position 42.

The construction of FIG. 5 makes it possible to restore the tank top into operation condition after a fire is extinguished, without having to obtain and remount a fusible link.

Figure 6:
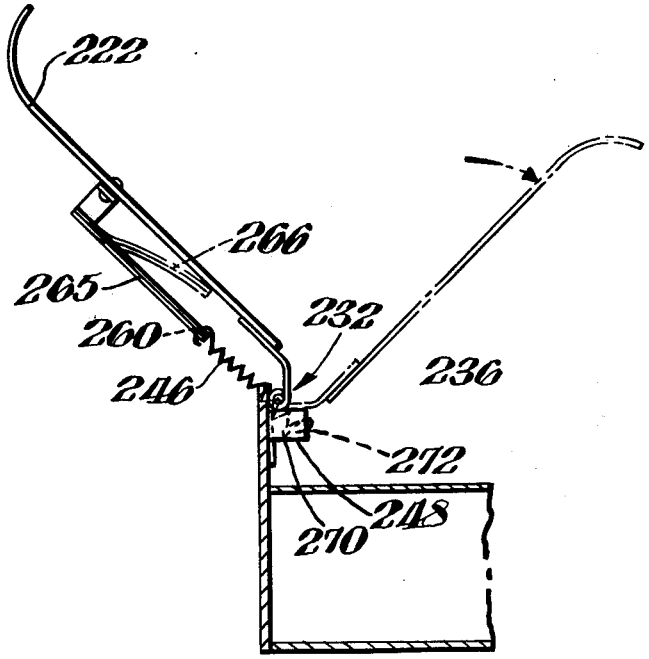
FIG. 6 is a view similar to FIG. 1 showing a still further embodiment of the present invention.

According to another alternative, the bias means of the present invention can be arranged as a toggle mechanism. This is illustrated in FIG. 6 where a weather shield plate 222 has an eye 260 for engagement by the end of spring 246, the eye 260 being held by a bimetallic strip 265 which is arranged to flex upwardly to the position shown in dash lines at 266, when heated by fire. Weather shield plate 222 is shown as supported by a hinge 232 having its hinge pin 236 displaced a significant amount from the plane defined by the body plate 222. A bracket 270 is secured to the floating roof in a manner that provides a mounting notch 272 for the end 248 of spring 246.

In the arrangement of FIG. 6 a fire will cause bimetallic strip 265 to deflect upwardly far enough to carry the spring 246 over-center with respect to hinge pivot 236 and thus cause the spring 246 to toggle plate 222 to its inwardly inclined position.

Obviously many modifications and variations of the present invention are possible in the light of the above teachings. It is, therefore, to be understood that within the scope of the appended claims the invention may be practiced otherwise than as specifically described.

What is claimed:

1. In a floating tank top having a deck pivotally carrying a set of weather shield plates around its periphery and extending upwardly, with bias means urging the plates outwardly so they press against the inner surface of a tank wall in which the top is mounted, the improvement accordingly to which the plates are shaped to tilt inwardly and the bias means includes a thermally responsive mechanism that tilts the plates back inwardly when they are subjected to fire.

2. The combination of claim 1 in which the thermally responsive mechanism is connected to tilt the plates inwardly so they make an angle between about 30° and about 60° with respect to the vertical.

3. The combination of claim 1 in which the plates overlap each other and are shaped so that some are capable of tilting inwardly without interference from adjoining plates that are not tilted inwardly.

4. The combination of claim 1 in which the thermally responsive mechanism includes a counterweight on the lower portion of a plate and a thermally operated bias-disabling element for that plate.

* * * * *

UNITED STATES PATENT AND TRADEMARK OFFICE

CERTIFICATE OF CORRECTION

PATENT NO. : 4,004,708

DATED : JANUARY 25, 1977

INVENTOR(S) : MARTIN C. BOYD

It is certified that error appears in the above-identified patent and that said Letters Patent are hereby corrected as shown below:

Col. 2, line 4, after "down" insert --against--.

Col. 2, line 60, after "tiered" (first occurrence) insert --plates--.

Col. 4, in the sixth line of claim 1, change "accordingly" to --according--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*